US010246884B2

(12) United States Patent
Busby

(10) Patent No.: US 10,246,884 B2
(45) Date of Patent: Apr. 2, 2019

(54) FLOORING SUBSTRATE SUPPORT SYSTEM

(71) Applicant: Philip Busby, Portland, OR (US)

(72) Inventor: Philip Busby, Portland, OR (US)

( * ) Notice: Subject to any disclaimer, the term of this patent is extended or adjusted under 35 U.S.C. 154(b) by 422 days.

(21) Appl. No.: 14/918,336

(22) Filed: Oct. 20, 2015

(65) Prior Publication Data

US 2017/0107726 A1 Apr. 20, 2017

(51) Int. Cl.
*E04F 15/024* (2006.01)

(52) U.S. Cl.
CPC .. *E04F 15/02476* (2013.01); *E04F 15/02494* (2013.01)

(58) Field of Classification Search
CPC ..... E04F 15/02476; E04F 15/02494; E04F 15/024; E04F 15/02405; E04F 15/02411; E04F 15/02458; F16B 43/02; E04B 5/48; E04C 2/52
USPC ..... 52/126.6, 126.7, 220.2, 220.5, 263, 471; 411/537
See application file for complete search history.

(56) References Cited

U.S. PATENT DOCUMENTS

| | | | | |
|---|---|---|---|---|
| 3,714,678 | A * | 2/1973 | Weisz | E05D 11/04 16/224 |
| 4,860,513 | A * | 8/1989 | Whitman | E04D 3/3603 411/369 |
| 5,542,777 | A * | 8/1996 | Johnson | B61D 17/043 403/384 |
| 6,115,972 | A * | 9/2000 | Tamez | E02D 27/34 248/181.1 |
| 7,650,726 | B2 * | 1/2010 | Jakob-Bamberg | E04B 5/48 248/188.2 |
| 9,126,631 | B2 * | 9/2015 | Lungershausen | B62D 27/065 |
| 2010/0180520 | A1 * | 7/2010 | Meyer | E04B 5/43 52/126.6 |

* cited by examiner

*Primary Examiner* — William V Gilbert
(74) *Attorney, Agent, or Firm* — Mark S. Hubert

(57) ABSTRACT

A flooring substrate system of polymer, open cell structural panels that may be attached to framing members beneath or placed atop of a waterproof membrane roof or deck structure. The panels are attached by a clip with a mechanical fastener that can be screwed into the lower framing members at a range of angles relative to the plane of the panel while the mechanical fastener and clip remain in complete mating engagement. The panels may also be operationally positioned using a disk that either has a threaded post that is bolted to the panel through a pin block and washer, a fixed pin or a pair of spring arms that lock onto rabbets in the panel's top face.

3 Claims, 18 Drawing Sheets

FIG 3
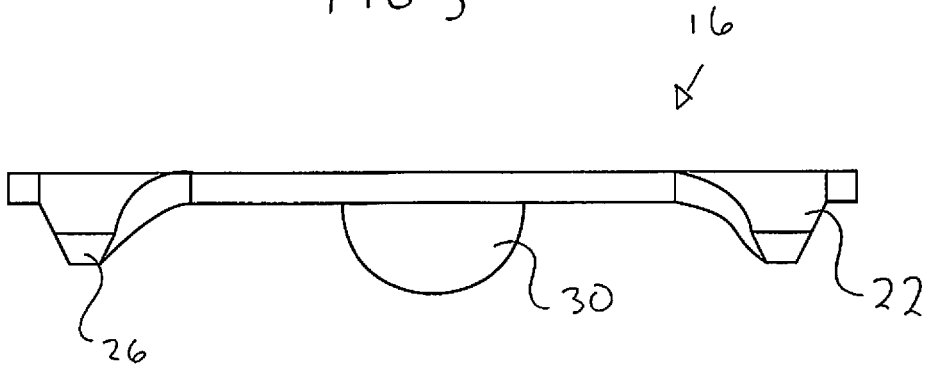
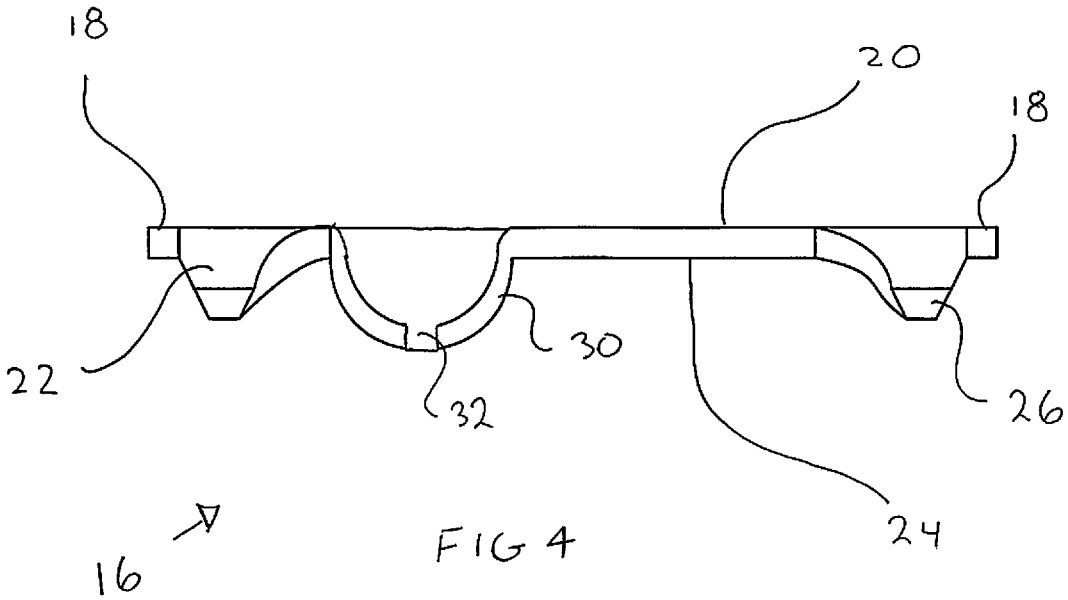
FIG 4

FIG 25
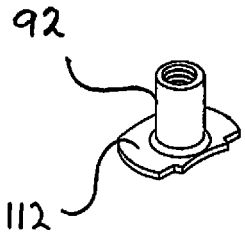
FIG 26
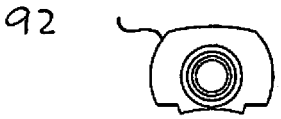
FIG 27
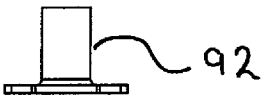
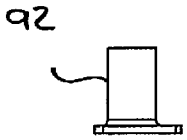
FIG 28

FIG 34
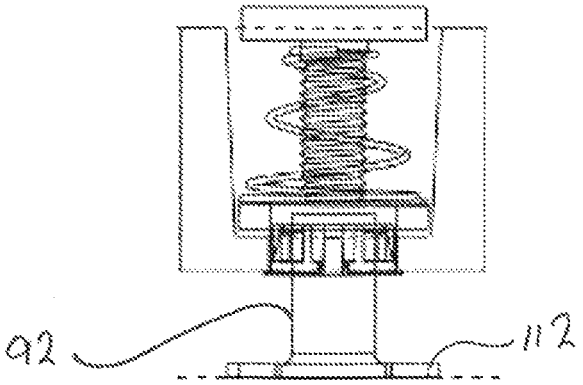
FIG 35
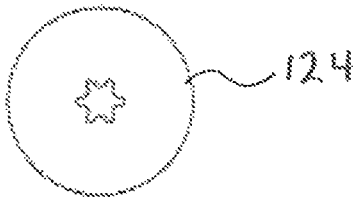
FIG 32
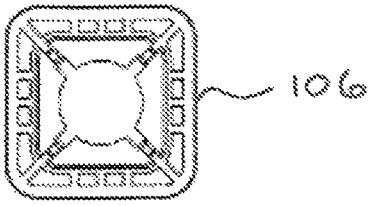
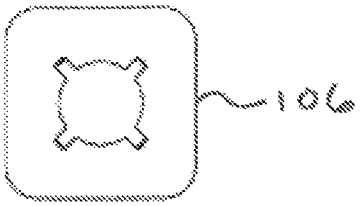
FIG 33

FLOORING SUBSTRATE SUPPORT SYSTEM

PRIORITY

This application claims priority from U.S. patent application Ser. No. 14/304,606 filed Jun. 13, 2014 and entitled "Precision Height Adjustable Flooring Substrate Support System which claims priority from the identically titled U.S. Provisional patent application Ser. No. 61/834,989 filed Jun. 14, 2013. Each of these applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

This invention relates to outdoor flooring, surfaces for decks, rooftop terraces, patios and the like. More particularly, to a decking system for enabling surfaces that lack suitable, level, structural features such as rooftops of commercial buildings, to be accommodate decks, rooftop terraces or patios.

Stone or stone-like walkways, terraces, patios and steps are frequently used at homes and businesses, as the appearance is attractive and enjoyed by many. Generally, these stones must be laid onto a level, on-grade, foundation. Walkway and step stones are typically rather thick, to provide sufficient internal structural properties to support weight necessary in walkway and step use. In addition, thin-gauged stones used in this same manner, with no internal structural properties, require a thick concrete pad for support.

Many residential second floor decks are sloped for drainage or are above waterproofed lower decks or living spaces and as such cannot tolerate mechanical penetrations that would breech the integrity of the deck's protective waterproofing. Common commercial roofs or decks have multiple slopes and numerous protrusions such as drains or vents and must have an elevated, level, flooring substrate system above the waterproofing to attach and or support the stones in order to present an aesthetically attractive and structurally stable planar array of stone. For joist framed decks to be finished with the same stone or stone-like material would require a solid, level, water resistant structural support spanning between multiple joist framing. This is not possible without breaking the rooftop membrane or seal that keeps the water out and allows any drainage to run off. Additionally, once decking is to be used above grade, wind forces may pose structural issues.

Henceforth, an outdoor flooring, deck, rooftop terrace and patio surface system that accommodates the attachment of a level, solid substrate for the attachment of outdoor flooring, would fulfill a long felt need in the construction industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a system that allows for the attachment of a planar, outdoor flooring substrate to a building deck/roof that is able to compensate for an unlevel, uneven or structurally broken surface and provide a level, drainable, planar, deck adapted for the attachment of stones, pavers, tiles and the like. One of the main objects is to prevent the penetration of any sealing surface of underlying structures. Another object of the present invention is to allow the maximum flexibility in methods of connection between the flooring substrate support system's structural panels and the building structure.

It has many of the advantages mentioned heretofore and many novel features that result in a new flooring substrate support system which is not anticipated, rendered obvious, suggested, or even implied by any of the prior art, either alone or in any combination thereof.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

BRIEF DESCRIPTION OF THE DRAWINGS

FIG. 3 is a side, cross sectional view of the panel screw clip taken through section AA of FIG. 2;

FIG. 4 is a side, cross sectional view of the panel screw clip taken through section BB of FIG. 2;

FIG. 25 is a perspective of the threaded post;

FIG. 26 is a bottom view of the threaded post;

FIG. 27 is a side view of the threaded post;

FIG. 28 is a side view of the threaded post rotated 90 degrees form FIG. 27;

FIG. 32 is a bottom view of the washer;

FIG. 33 is a top view of the washer;

FIG. 34 is a cross sectional view of the threaded post connected to the panel 60 with the base mounting plate removed for visual clarity;

FIG. 35 is a top view of the self centering bolt;

DETAILED DESCRIPTION

Figure 1:
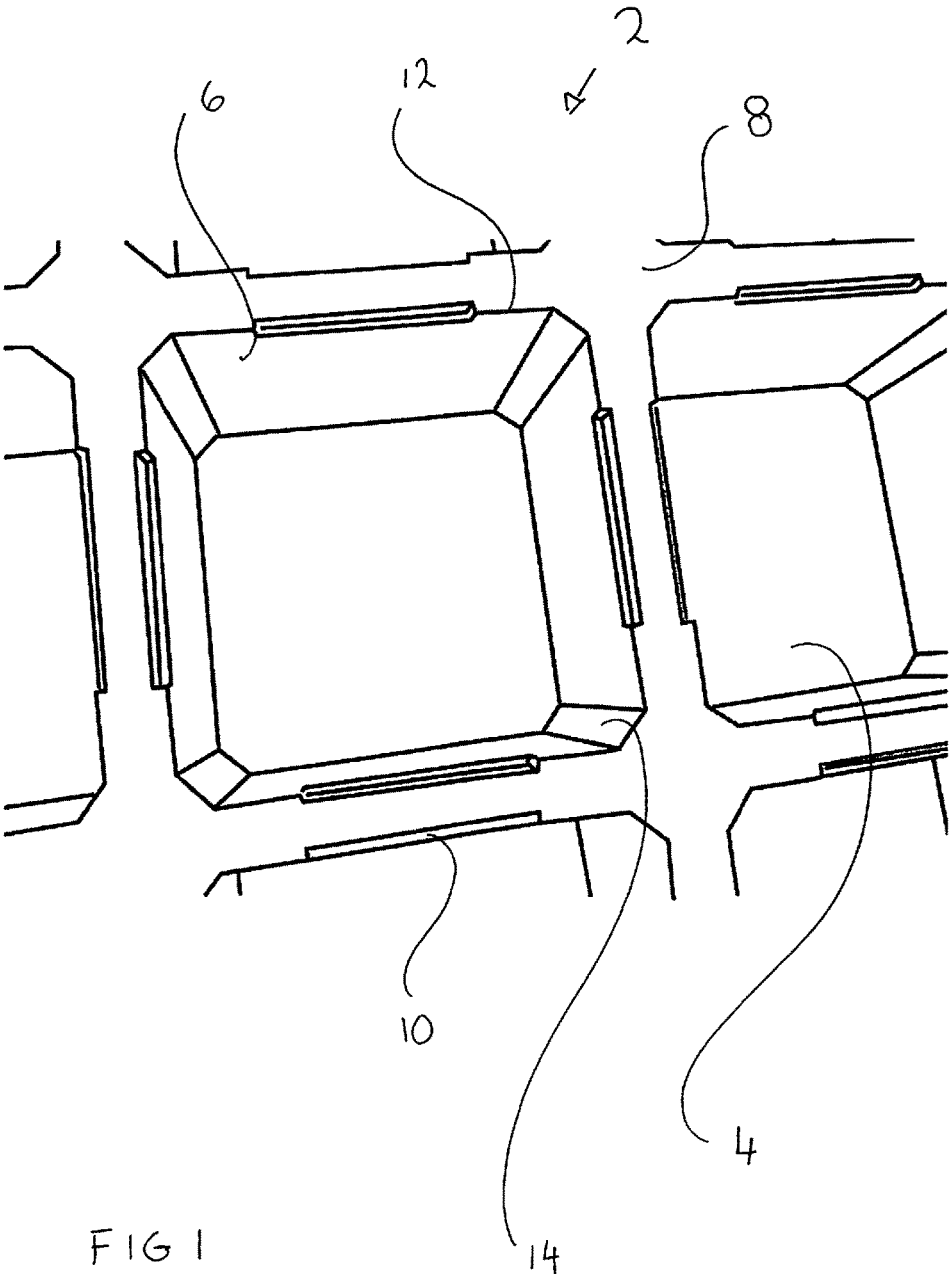
FIG. 1 is a top face perspective view of a cell centrally located in the series of open cells of the the open celled structural panel.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

The flooring substrate support system has as its primary element an open cell structural panel. It is to be noted that this while modified open celled structural panel 2 retains much of the structure of the open celled structural panel disclosed in U.S. patent application Ser. No. 14/304,606, filed Jun. 13, 2014, entitled "Precision Height Adjustable Flooring Substrate Support System," it has some structural differences that allows for the use of the dog-eared panel clip.

The preferred embodiment structural panel 2 (FIG. 1) is a planar, polymer panel with a repeatable series of adjacent open cells (orifices) 4. These open cells 4 are generally square with four tapered, sloped internal sides 6. The longest edge of the cell sides 12 lies along the top face 8 of the panel 2. The slope is inward toward the center of the cell 4 from their top edge to their bottom edge at approximately 2 degrees, with a minus 3 degree and plus 3 degree tolerance. The taper narrows the cell 4 from the top face 8 of the panel 2 to the bottom face of the panel 2, and enables the release of the modified open cell structural panels 2 from their fabrication mold. The cells 4 are wider (the distance between opposing cell sides) than the depth of the structural panel 2. The bottom face of the panel is smooth, planar and unadorned. The top face of the panel 8 has linear rabbets 10 cut partially along the four cell top edges 12. These are located at the interfaces between the top of the cell sides 6 and the top face 8 of the panel 2. In the preferred embodiment these rabbets 10 have an internal angle of approximately 90 degrees between their bottom and side faces. The rabbets 10 do not extend the entire length of the four edges 12 but are centered on each edge 12. The cell sides 6 of each open cell 4 do not meet the adjacent cell sides at 90 degrees, rather there is a 45 degree chamfer wall 14 that extends the entire depth of the cell at all four of the corners between adjacent cell sides.

The array of open cells in the modified open cell structural panel is spaced and sized for attachment to standard framing joists that are spaced 16" or 24" on center. The panel is 30"×48" and accommodates a 48" cut into smaller, working panels as necessary. Each of these cut panels retain a full perimeter bar structure so as to meet USA dimensional building standards and accommodate commercially available flooring products.

Figure 2:
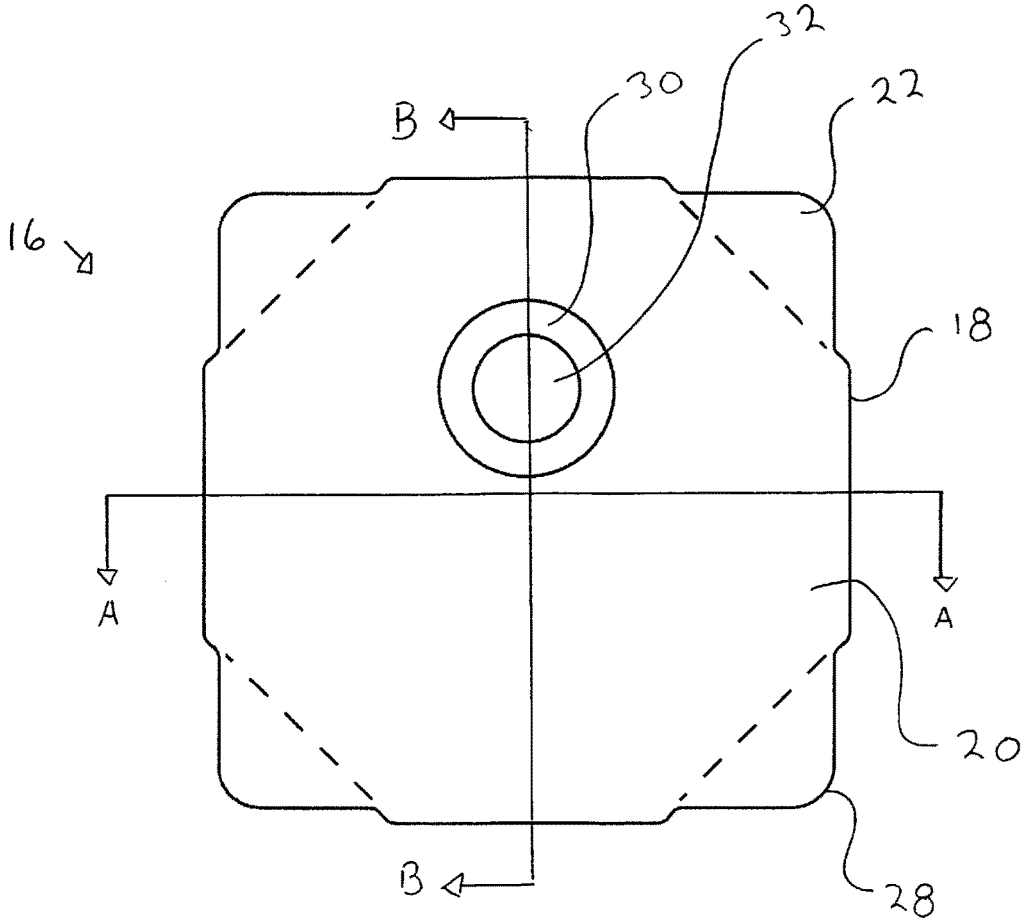
FIG. 2 is a top side view of the panel screw clip.

The open celled structural panel 2 is specifically configured for use with a panel screw clip 16 (FIGS. 2-4). This is a generally square extremely rigid disk, preferably made of steel, metal, or a polymer. The clip 16 has small tabs 18 that extend from each of its four sides extending along the same plane of the clip's top face 20. The four tabs 18 do not run along the entire length of the edges, are matingly conformed to the rabbet 10, and are centered along the edges. The four corners of the clip 22 are bent away, downwards, (in a dog-eared fashion) from the plane of the top face 20 at an obtuse angle with respect to the bottom face of the clip 24. The tips of the four corners 22 of the clip 16 do not meet at a 90 degree apex but rather terminate in a 45 degree chamfer 26 (FIGS. 3 and 4) or optionally, a slight radius 28 (FIG. 2). This chamfer 26 or radius 28 is cut back far enough from the tips of the four corners 22 to reduce the length of the tips 22 so that the tips 22 clear the 45 degree chamfer wall 14 that extends the entire depth at all four of the corners between adjacent cell sides when the clip 16 is inserted with its top face 20 parallel to the top face of the panel 8. However, when the clip 16 is inserted into the cell 4 such that the plane of its top face 20 is coplanar with the top face of the structural panel 8, the chamfer 26 on the tips 22 of the clip 16 frictionally engage the chamfer wall 14 contemporaneously with the seating of the four tabs 18 into the four rabbets 10. In this way, the clip 16 resides locked in its operational, horizontal configuration which is coplanar with the plane of the top face of the structural panel 2.

Figure 5:
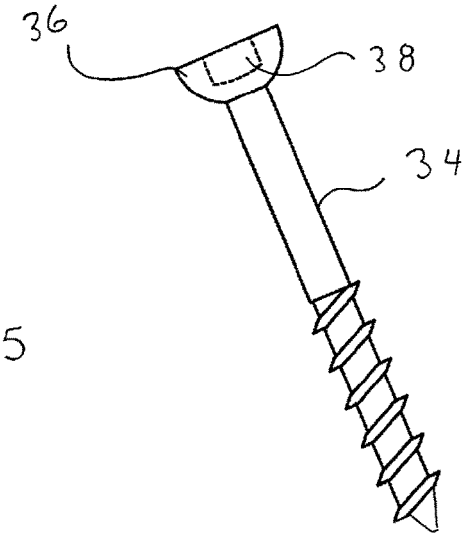
FIG. 5 is a side view of the bowl headed mechanical fastener.

In the clip 16 is a hemispherical indentation (bowl) 30 extending downward from the top face 24. The bowl 30 has a circular orifice 32 formed therethrough, matingly conformed to receive a hemispherical head (bowl head) mechanical fastener 34 (FIG. 5). Since the clip 16 is square, it has two, identical longitudinal axes located 90 degrees apart. The bowl 30 is not located in the center of the clip 16. Rather, it is located centered about a point on the midpoint line between two of the opposing cell sides 6 (FIG. 3) as shown as section line BB of FIG. 2 (one of the longitudinal axes of the clip). It does not lie anywhere along the midpoint line between the remaining opposing cell sides 6.

In the preferred embodiment, the bowl head mechanical fastener 4 is a screw, having screw threads about its shaft terminating at its distal end, and a hemispherical head 36 at its proximal end. (Although it is envisioned in specific situations a bolt rather than a screw thread may be employed on the mechanical fastener.) The driving recess 38 in the top face of the hemispherical head 36 may be configured to accept any of the known driver bits, be it Phillips, Robertson, slotted, hex, Torx or the like.

The mechanical fastener in the preferred embodiment is a bowl head screw 34 differs from a conventional bugle head screw because the bowl head screw 34 has a hemispherical drive head 36 at the proximal end of its threaded shaft. In comparison, bugle head screws have heads with tapered, not curved, sides between the face of the head and the shaft. The bowel head screw 34 is matingly conformed to the bowl indentation in the panel screw clip 16.

Figure 6:
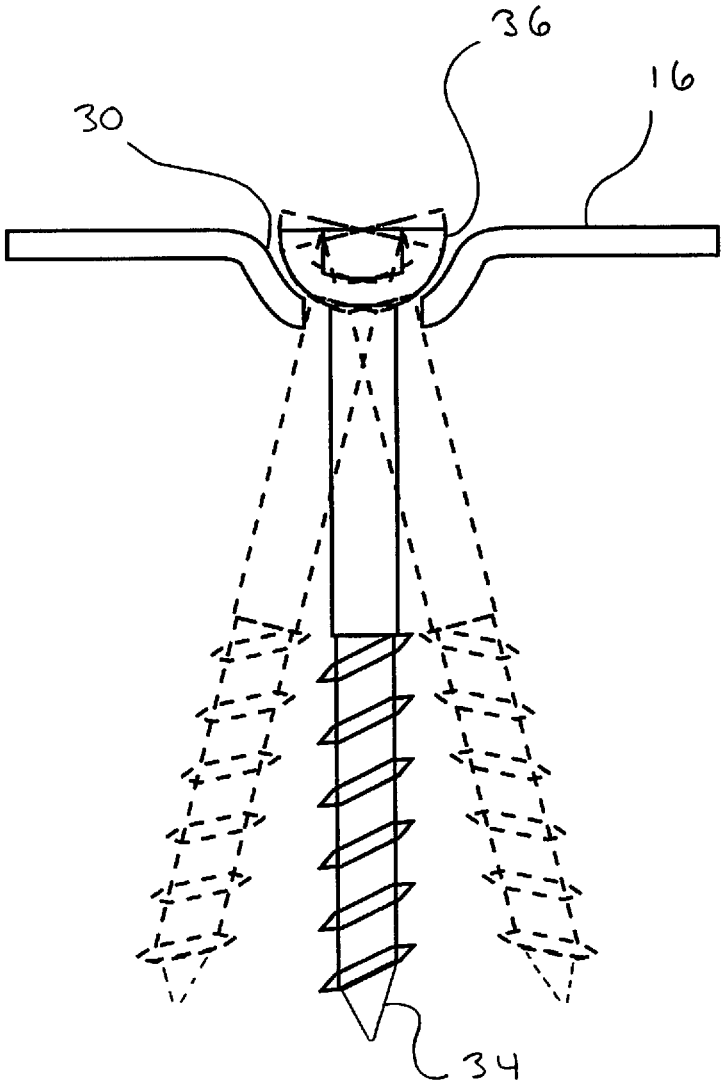
FIG. 6 is an illustrative side view showing the allowable movement of a bowel head mechanical fastener in a bowel recess.

It is to be noted that the diameter of the circular orifice 32 exceeds the diameter of the shaft of the mechanical fastener 34. The outer diameter of the hemispherical drive head 36 is larger than the inner diameter of the circular orifice 32. By utilizing the mating hemispherical configurations of the bowl 30 and the fastener 34 in conjunction with the oversized orifice 32, the mechanical fastener 34 is free to pivot/swivel about 360 degrees in the bowl 30 within a limited angular range as illustrated in FIG. 6. (This angular range is dictated by the difference in size between the diameter of the mechanical fastener's shaft and the hemispherical bowl 30. Generally this is about 50 degrees.) This ability for the mechanical fastener 34 to pivot/swivel within the clip 16 accomplishes two things. First, it allows the bowl head screw 34 to be pivoted to different vertical angles within the panel screw clip 16 so as to allow connection to structural members beneath the structural panel that are not in complete vertical alignment with the orifice 30 in the panel screw clip 16. Second, it allows for complete mating engagement between the curved hemispherical surfaces of the hemispherical body drive head and the inner bowl indentation of the panel screw clip 16. (Complete mating engagement is defined herein as having at least 80 percent of the curved surfaces of the hemispherical body drive head in contact with the matingly configured outer surface of the indentation of the panel screw clip 16. This is attainable even at angles of 25 degrees from vertical.) This complete mating engagement spreads out the contact forces between the head of the mechanical fastener and the clip 16, about the entire surface of the bowl and prevents tear through of the mechanical fastener 34 under high tensile load conditions. In the preferred embodiment, since the intended use for the structural panel 2 is outdoors, stainless steel is the preferred material of construction for the mechanical fastener and the clip.

The rabbets 10 along with the dog-eared corners of the panel screw clip are to locate and stabilize the panel screw clip 16 parallel to the top face of the panel 8 while the bowel head mechanical fastener 34 is inserted and angled to locate a securement point beneath that it can secure the panel 2 to. In use, the clip 16 with its installed mechanical fastener 34 will rest in its final position no higher than flush with the top face 8 of the structural panel 2 such that no machining is required to place a finished stone, tile, concrete surface directly over the structural panel 2. The panel 2 is operationally engageable with all of the components of the flooring substrate system disclosed in U.S. patent application Ser. No. 14/304,606, filed Jun. 13, 2014, entitled "Precision Height Adjustable Flooring Substrate Support System."

The preferred embodiment structural panel 2 (FIG. 1) may also be located directly atop a spacer plate assembly 44 (FIGS. 12 and 13) which would rest on top of a waterproof membrane on a deck or roofing structure. This type of installation does not require any penetrations through the waterproof membrane, and allows the structural panels to float above the deck or roof between ¼ and ⅜ of an inch. The substantial weight of the panels and the applied flooring materials anchor the floor to the deck or roof.

Figure 7:
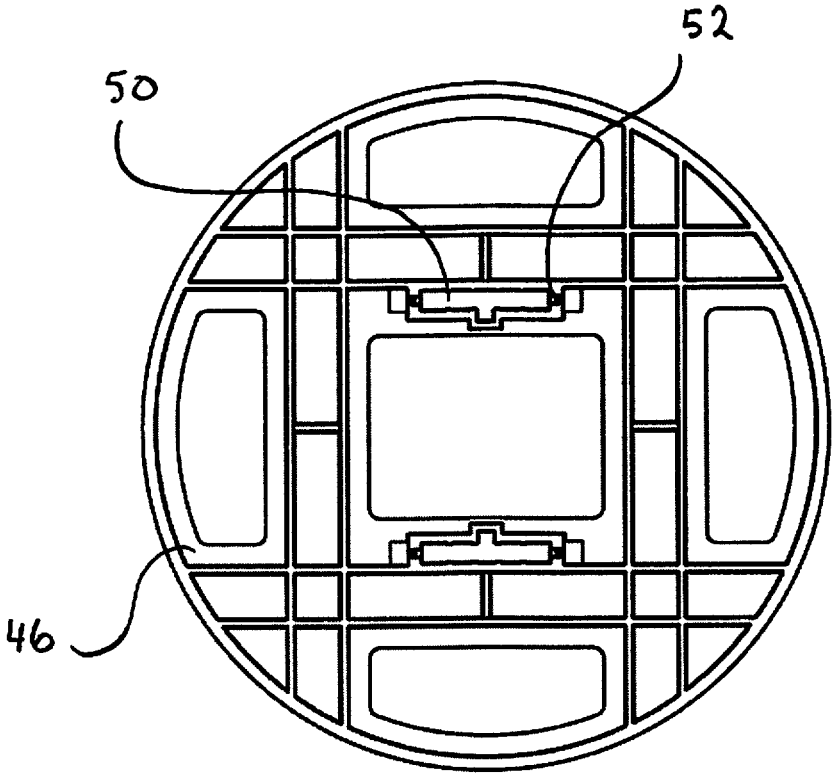
FIG. 7 is a top view of the spacer plate.
Figure 8:
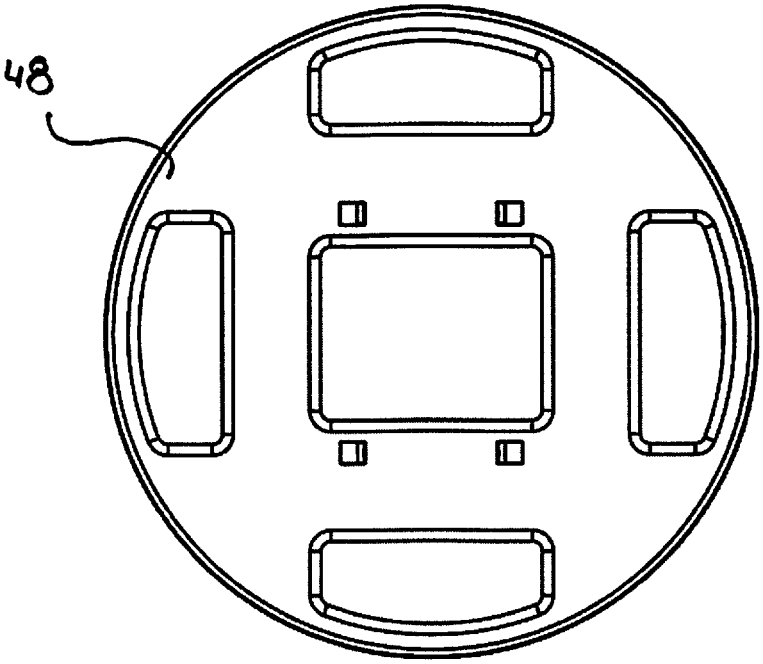
FIG. 8 is a bottom view of a spacer plate.
Figure 9:
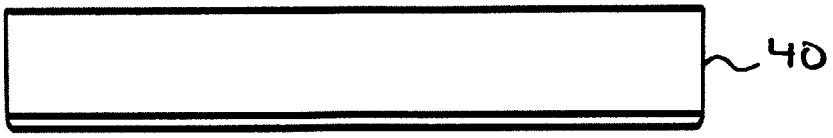
FIG. 9 is a side view of the spacer plate.
Figure 10:
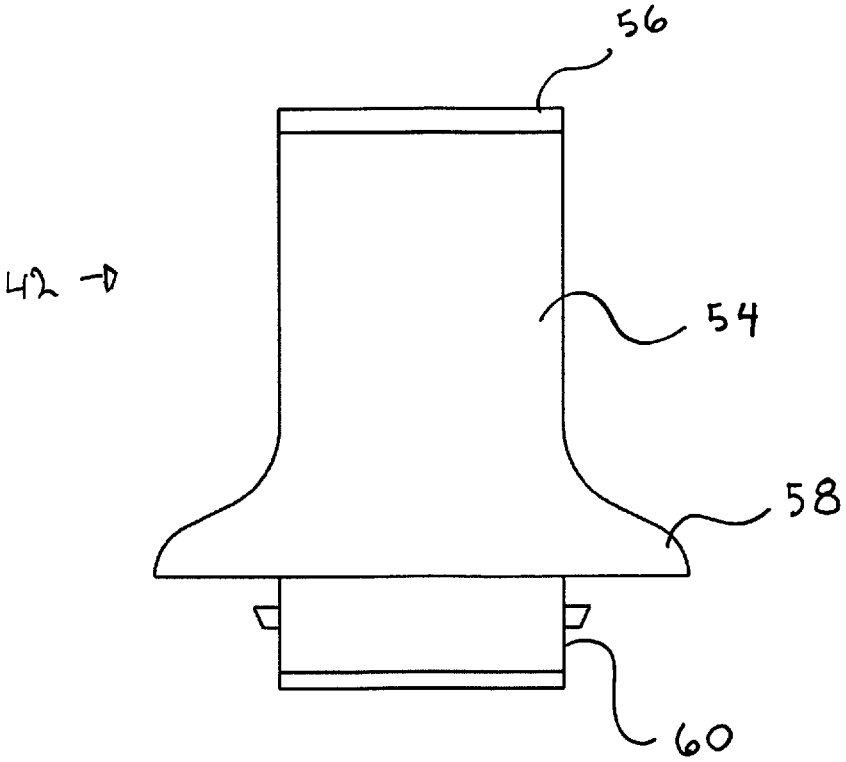
FIG. 10 is a side view of the spacer plate arm.
Figure 11:
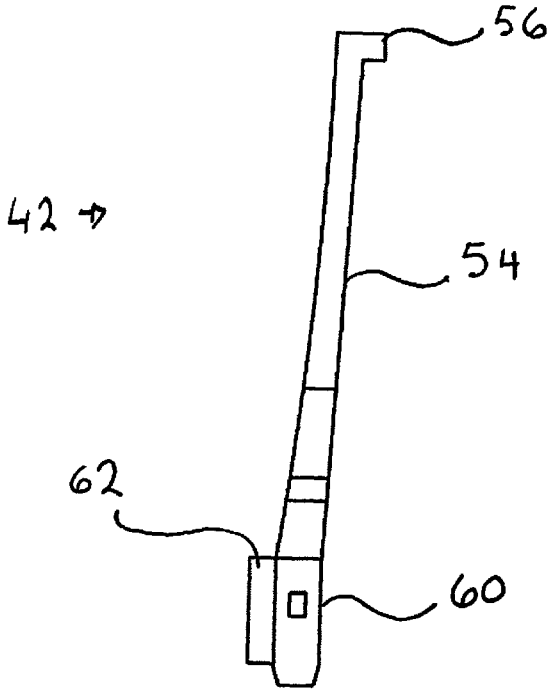
FIG. 11 is a side view of a spacer plate arm.
Figure 12:
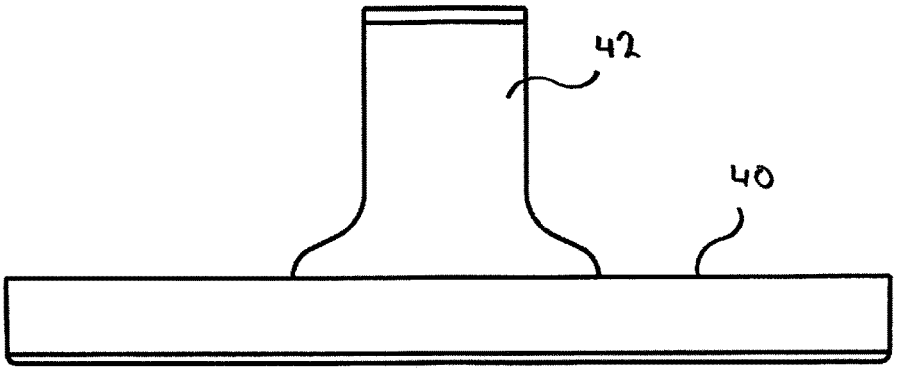
FIG. 12 is a side view of a spacer plate with arms installed.
Figure 13:
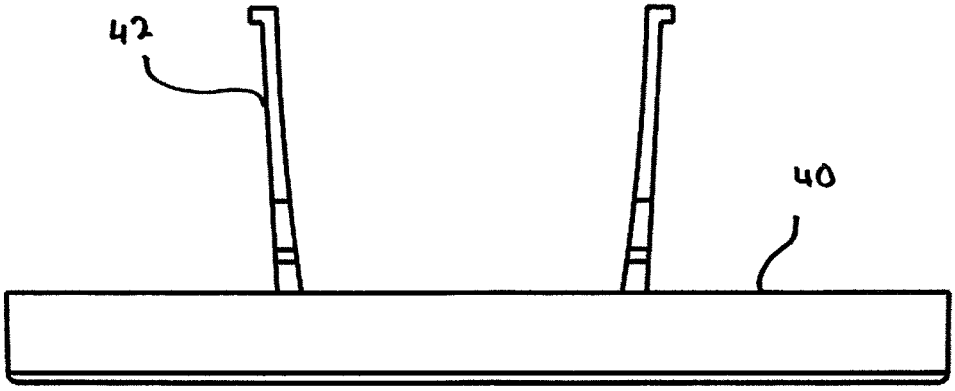
FIG. 13 is the side view of FIG. 12 rotated 90 degrees.

The spacer plate assembly 44 is made of a planar spacer plate 40 (FIG. 9) and a pair of substantially identical spring arms 42 (FIGS. 10 and 11) that extend normally, opposing one another, from a top face 46 thereof (FIGS. 12 and 13). The spacer plate 40 has an angled "Tee socket" 50 formed on its top face 46 that runs the full depth of the spacer plate 40 down to the bottom face, and matingly engages the "Tee tab" configuration found on the bottom end of the spring arms 42. (FIG. 7) The Tee socket 50 forms a 90 degree vertical angle with the horizontal plane of the body of the spacer plate. The Tee socket 50 has two opposing tapered grooves 52 formed down its depth that each terminate in an orifice. The bottom face of the spacer plate 48 is unadorned. (FIG. 8)

Figure 14:
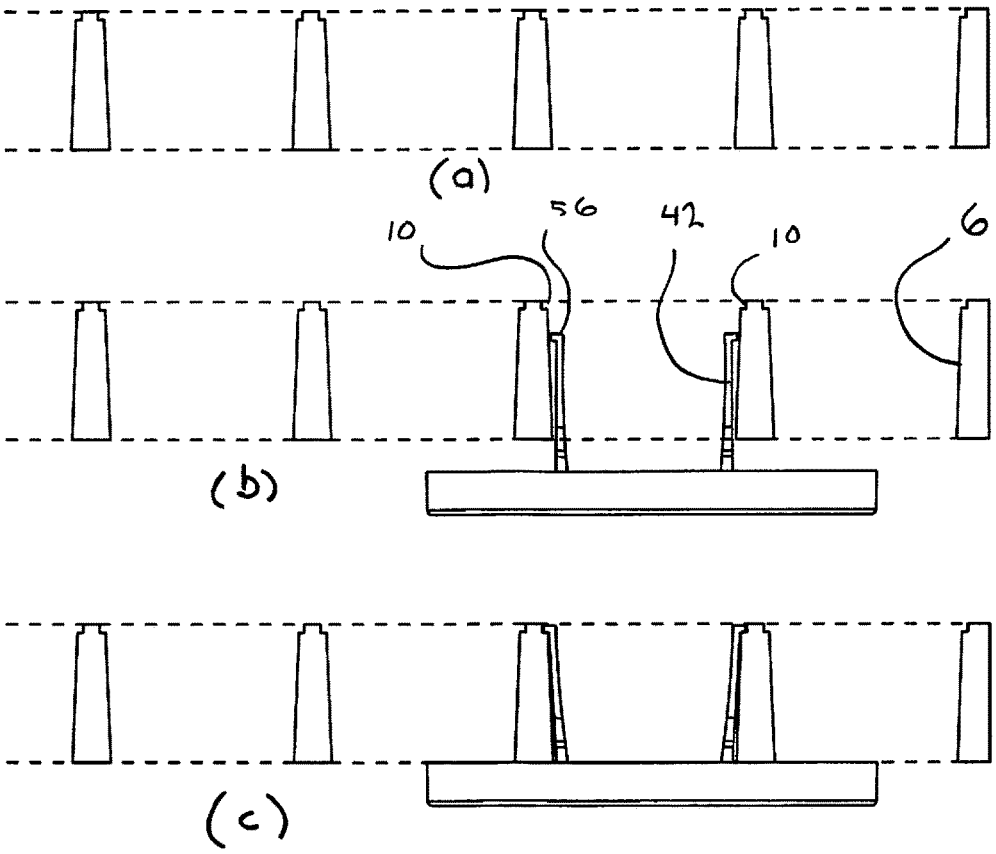
FIGS. 14(*a*)-(*c*) is a side view of sequential spacer plate installation illustrations.

The spring arms 42 (FIGS. 10 and 11) have a planar body 54 with a lip 56 extending normally from the proximal edge of their outer face. At the distal end of the body is an obtuse angled "Tee tab" 60. The Tee tab 60 has a central ridge 62 extending along its depth that engages the Tee socket 50. There are also two locking tabs 64 that extend from the sides of the Tee tab that are engageable in the orifices at the bottom of the opposing tapered grooves 52 in Tee socket 50 to lock in the spring arms 42 to the spacer plate 40. The body 54 has a set of stabilizing legs 58 that broaden the profile of the arms 42 and prevent their lateral movement under load. The obtuse angle that the Tee tab 60 extends from the body of the spring arm 54 allows the spring arms 42 to extend with a slight "Vee" configuration between them so that there is a greater distance between the tops of the arms 42 than the bottoms of the arms 42. The distance between the lips 56 at the distal end of the spring arms exceeds the distance between opposing cell sides 6. In installation, (FIGS. 14(*a*)-(*c*)) the pair of spring arms 42 are compressed toward each other when inserted into an open cell. The lips 56 frictionally slide along the cell sides 6 until the lips 56 reach the rabbets 10 where the spring arms tension forces the lips 56 into the rabbets 10 where they lock the panel and the spacer plate together.

Figure 15:
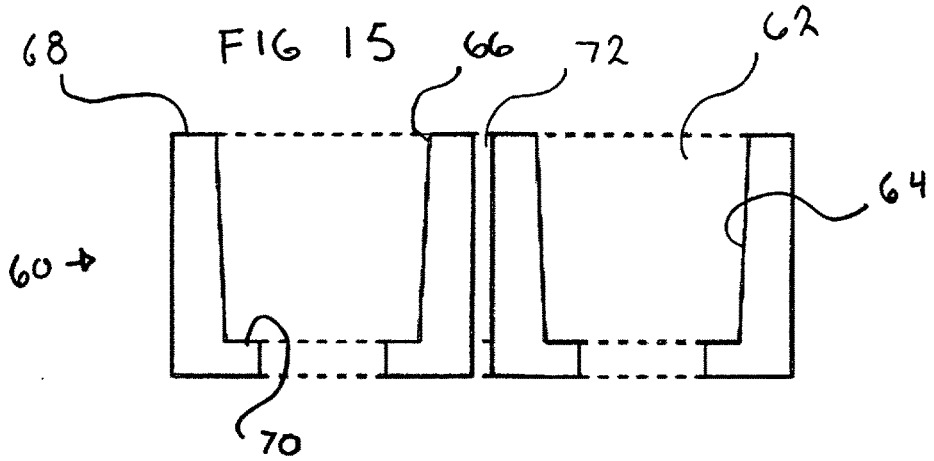
FIG. 15 is a side view of the alternate embodiment open celled structural panel.
Figure 16:
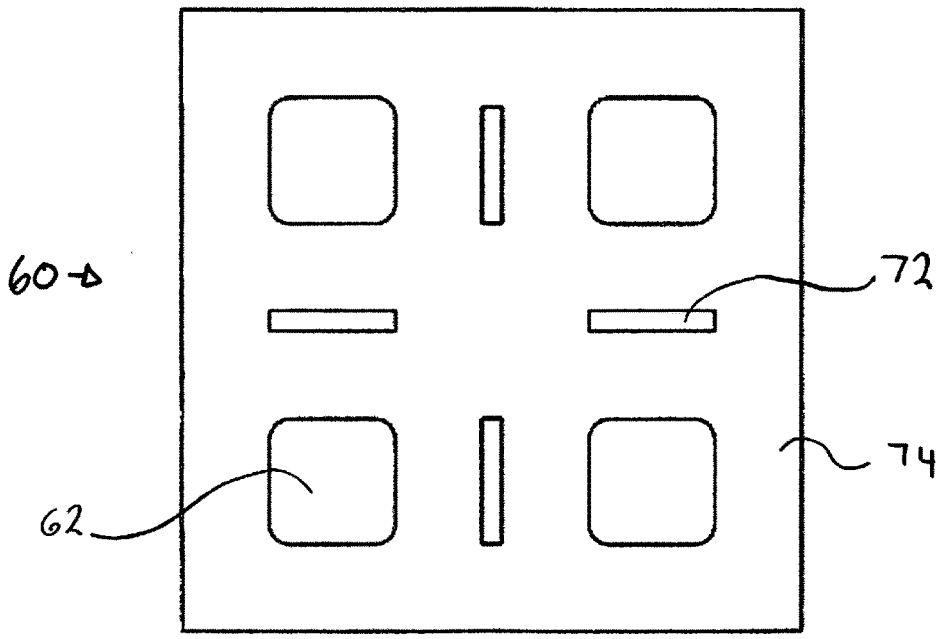
FIG. 16 is a bottom view of the alternate embodiment open celled structural panel.

The alternate embodiment structural panel 60 (FIGS. 15 and 16) is a planar, polymer panel designed for commercial applications (and also for high wind applications) and is thus made in a larger size (30 in by 24 inches) than the preferred embodiment panel 2. It has a repeatable series of adjacent open voids 62. These open voids 62 are generally square with four tapered, sloped internal sides 64. The longest edge of the void sides 66 lies along the top face 68 of the panel 60. The slope is inward toward the center of the void 62 from their top edge to their bottom edge at approximately 2 degrees, with a minus 3 degree and plus 3 degree tolerance. The taper narrows the void 62 from the top face 68 of the panel 60 to the bottom internal flange 70 that extends from the bottom of each of the four void walls 64 the panel 60. As such the panel 60 has an upper opening 82 on the top face 68 and a smaller, lower opening on its bottom face 84. Since this panel is a commercial building product, it is much thicker to span greater distances, (generally over framing members) unsupported across its entire surface. The preferable thickness of this panel 60 is 1 and ⅛ inches deep with the bottom internal flange 70 and the void wall 64 having a thickness of ⅛ to 3/16 of an inch. There is a series of linear cutting perforations 72 about the four sides 64 of each void 62 that extend completely through the panel 60. These enable the insertion of a reciprocating saw blade and guide its direction when the panel 60 is being cut to size in the field. These cutting perforations 72 are 1½ inches apart. The bottom face 74 of the panel is smooth, planar and unadorned. The top face 68 and the bottom face 74 are parallel and the sides 64 are approximately perpendicular (within 5 degrees) to the top and bottom faces. The panel 60 is designed for use with a mechanical fastening system. The two common fastening systems are the alternate embodiment panel clip 76 with a threaded mechanical fastener 34, and the pin block 94 connected to a base mounting plate 90/threaded post 92 arrangement by a self centering polymer bolt 104 and washer 106.

Figure 18:
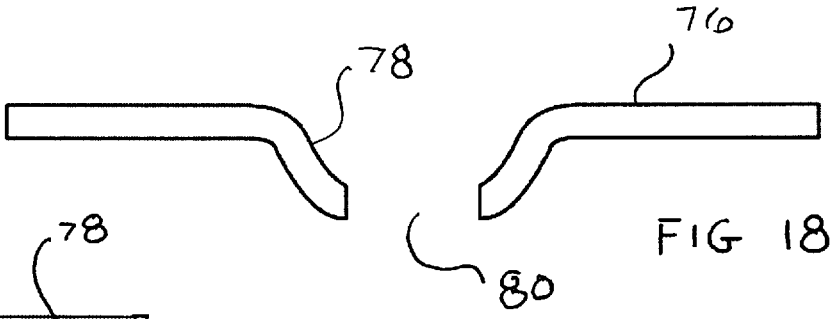
FIG. 18 is a side cross sectional view of the alternated embodiment panel clip.
Figure 17:
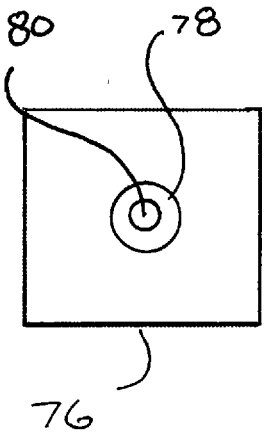
FIG. 17 is a top view of the alternate embodiment panel clip.
Figure 20:
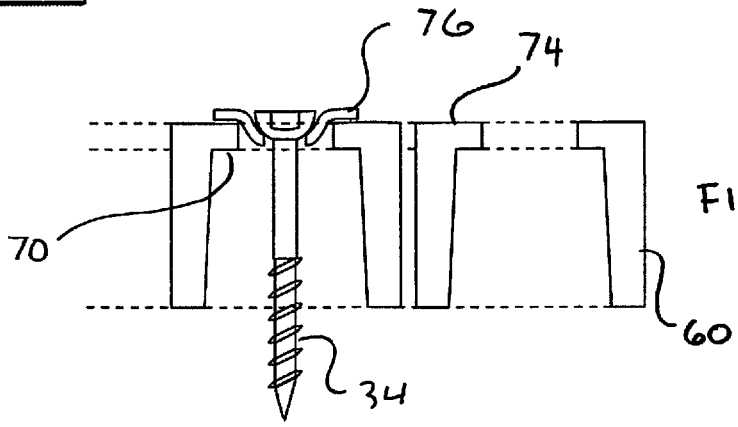
FIG. 20 is a side cross sectional view of the alternate embodiment panel clip affixed to the top of the the alternate embodiment open celled structural panel.
Figure 19:
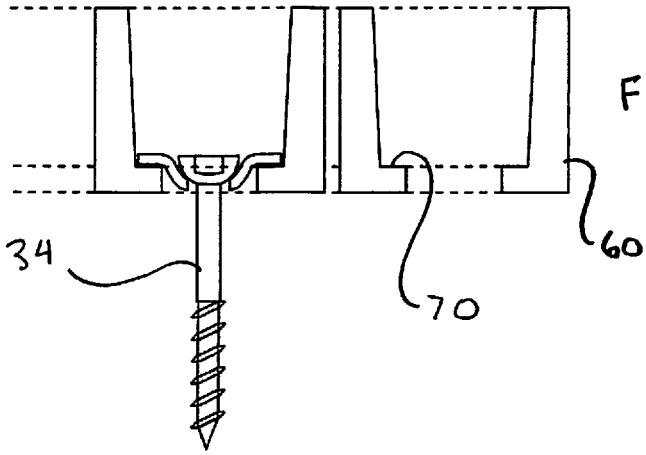
FIG. 19 is a side cross sectional view of the alternate embodiment panel clip affixed on the cell bottom of the alternate embodiment open celled structural panel.

The alternate embodiment structural panel 60 is designed for attachment to framing members that form the support structure for above deck or floor. The alternate embodiment structural panel 60 may be installed with its top face 68 or its bottom face 74 directly atop of the structural members. (FIGS. 19 and 20) This is accomplished utilizing the bowl head screw 34 and an alternate embodiment panel clip 76, which is a planar, rigid square plate (FIGS. 17 and 18) having a central bowl (hemispherical) depression 78 with a central hole 80 formed there through. The bowl head screw 34 and alternate embodiment panel clip 76 function in the same manner and offer the same advantages from a completely mating engagement as the clip 16 and mechanical fastener 34 described herein.

When the top face 68 of the alternate embodiment structural panel 60 resides upward (FIG. 19), the alternate embodiment panel clip 76 and mechanical fastener 34 are inserted into the void until the clip 76 lies on all four sides of the internal flange 70. The clip 76 is dimensionally sized approximately the same size as the flange 70 so as to spread out all of the tension forces from the mechanical fastener 34 on the complete flange. In this configuration, the alternate embodiment structural panel 60 forms a planar surface to attach a flooring material.

When the bottom face 74 of the alternate embodiment structural panel 60 resides upward (FIG. 20), the alternate embodiment panel clip 76 and mechanical fastener 34 are placed centered over the open void 62 so as to rest on the bottom face 74 of the alternate embodiment structural panel 60 (which is now upside down). This creates a planar surface with the alternate embodiment structural panel 60 having a greater solid surface that its aforementioned configuration. This configuration however, leaves the clip 76 and mechanical fastener standing slightly raised above the panel's planar surface. This configuration is used when a walking, unadorned deck is desired.

Figure 21:
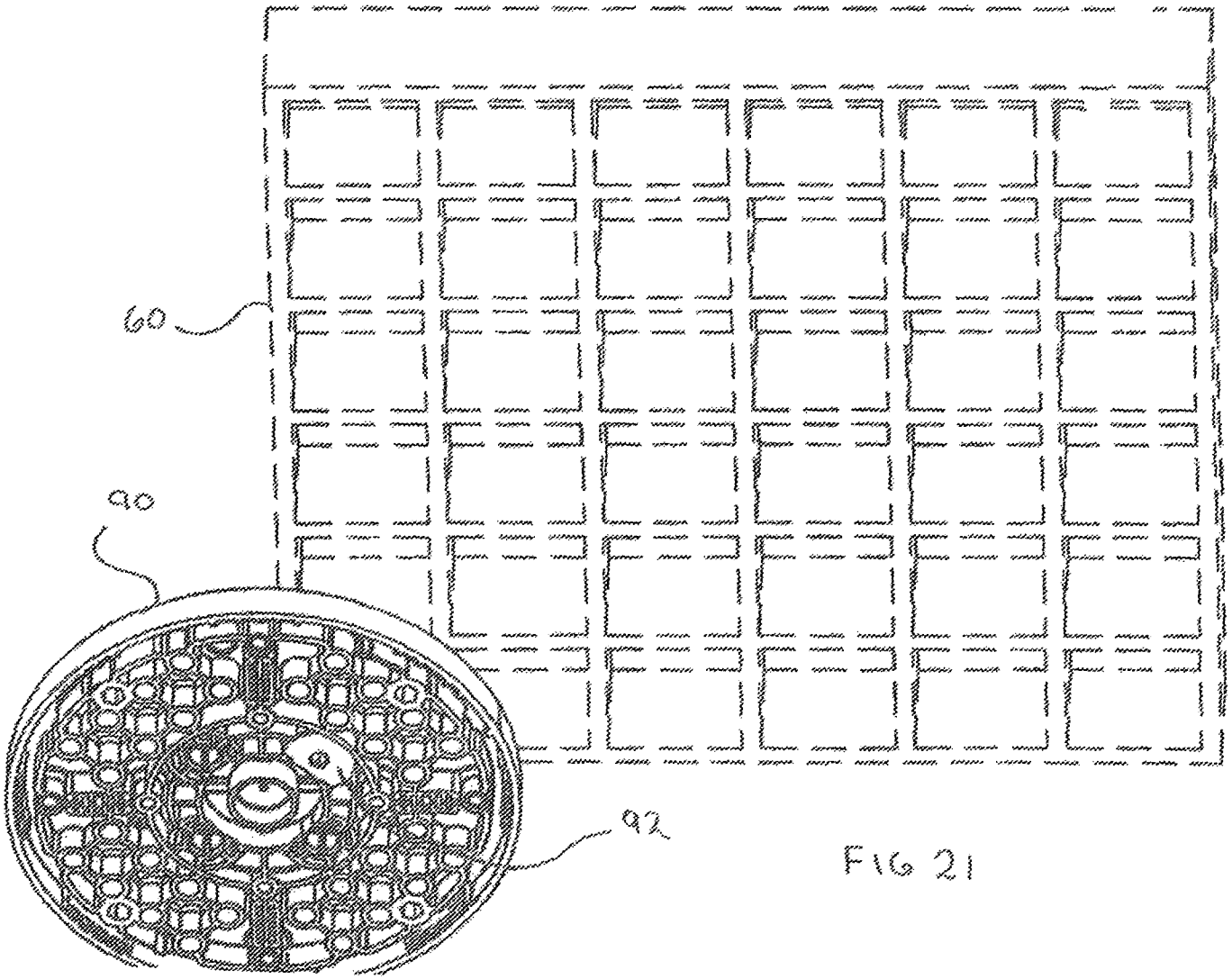
FIG. 21 is a bottom perspective view of the base mounting plate beneath the alternate embodiment structural panel.
Figure 22:
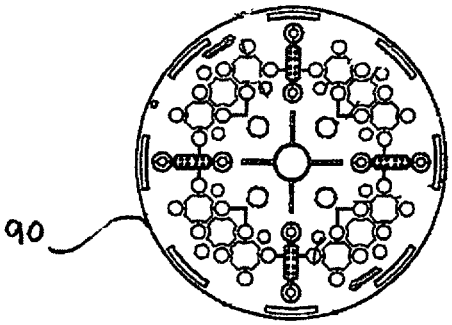
FIG. 22 is a top view of the base mounting plate.
Figure 23:
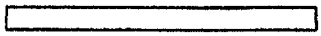
FIG. 23 is a side view of the base mounting plate.
Figure 24:
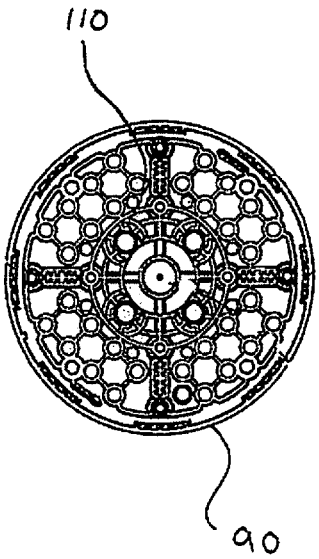
FIG. 24 is a bottom view of the base mounting plate.

The alternate structural panel 60 may also be used with another mechanical fastening system. This second fastening system allows the connection of the panel 60 to the base mounting plate 90 and threaded post 92 arrangement (both detailed in copending U.S. patent application Ser. No. 14/304,606, filed Jun. 13, 2014, entitled "Precision Height Adjustable Flooring Substrate Support System" and incorporated herein by reference.) FIG. 21 shows the base mounting plate 90 (FIGS. 22-24) with the threaded post (FIGS. 25-28) installed and mounted to the alternate embodiment structural panel 60. Generally, the base mounting plate will be positioned so as to support the corners of four adjacent structural panels although it may be located in a plethora of positions beneath the panel.

Figure 29:
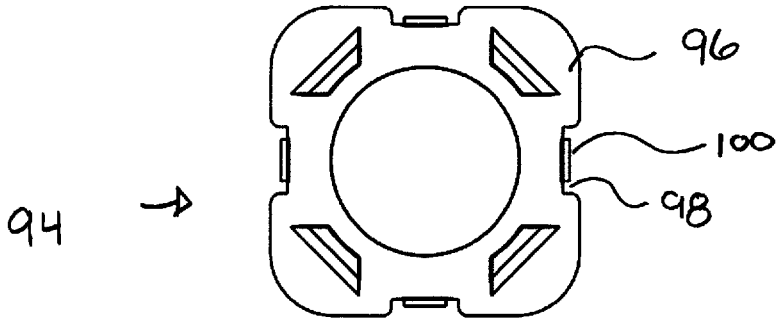
FIG. 29 is a top view of the pin block.
Figure 30:
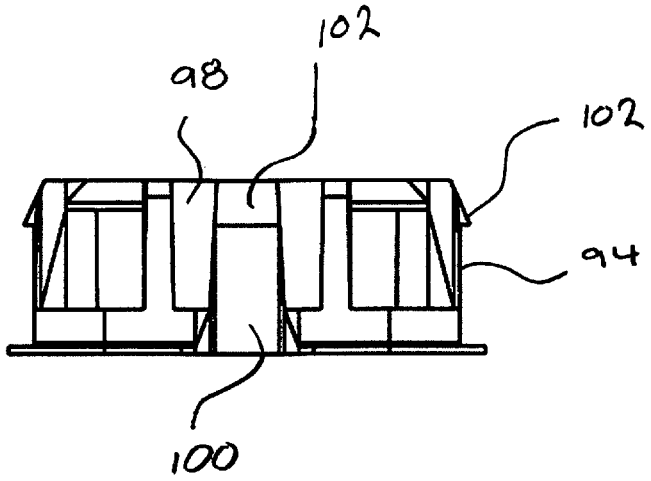
FIG. 30 is a side view of the pin block.
Figure 31:
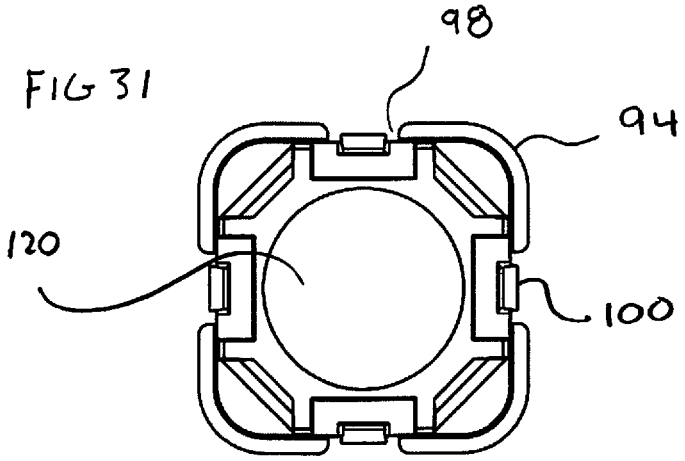
FIG. 31 is a bottom view of the pin block.

To facilitate the connection of the alternate embodiment structural panel 60 to the base mounting plate 90 requires a pin block 94. (FIGS. 29-31) The pin block 94 is a locking plug that has a top face 96 with a profile that is larger in all directions than the inner dimensions of the inner flange 70. It has a series of grooves 98 formed about its side wall periphery from which extends a series of spring locking clips 100. These locking clips 100 have angled locking lugs 102 at their distal ends that are located at a distance along the locking clips 100 from the top face 96 that is equal to the thickness (depth) of the inner flange 70. (FIGS. 29-31) When the pin block 94 is inserted into the lower opening 84 void 62 from the bottom face of the panel 60, the spring locking clips 100 with their angled locking lugs 102 will flex inward slightly as they contact and slide up the side walls of the flange 70 until the flange top face 96 of the pin block 94 contacts the bottom face 74 of the panel 60 at which time the angled locking lugs 102 expand outward to engage the upper face of the flange 70 and lock the pin block 94 to the panel 60.

Figure 36:
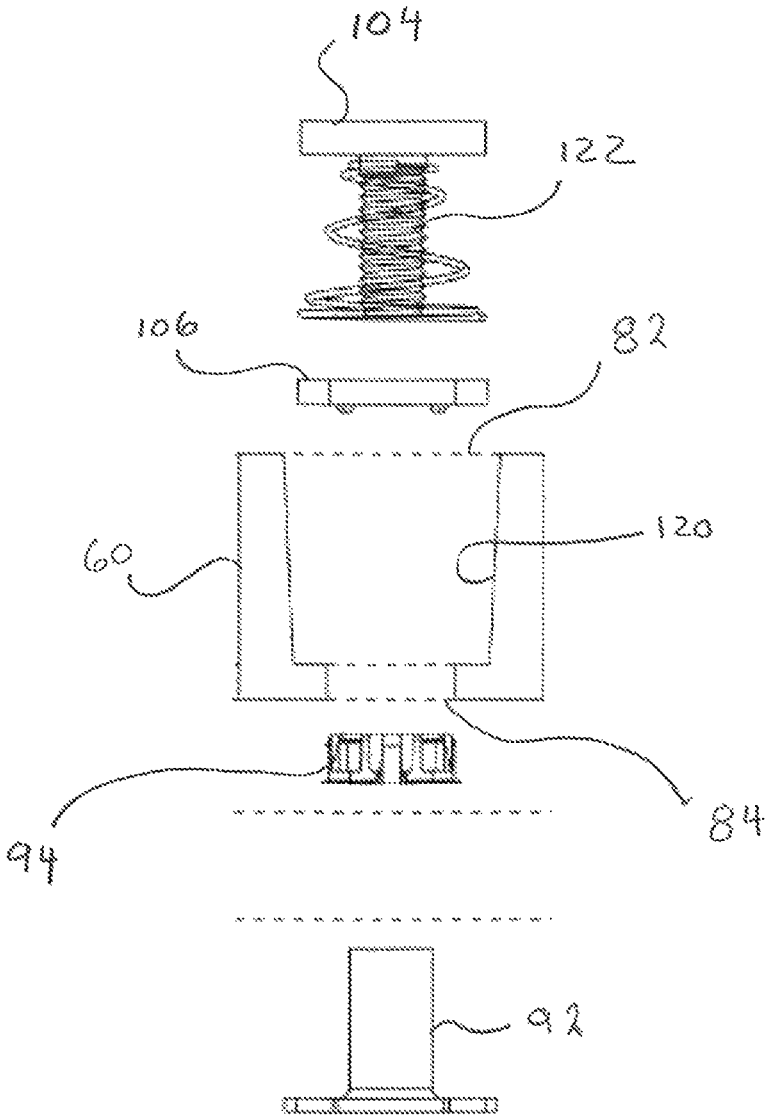
FIG. 36 is an exploded view of the assembly of FIG. 34.
Figure 37:
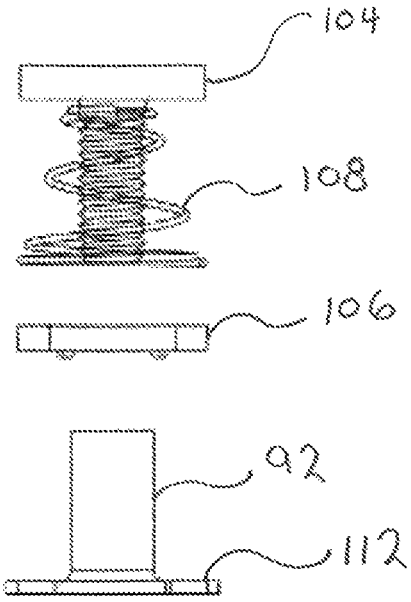
FIG. 37 is an exploded view showing the self centering bolt, the washer and threaded post.

Referencing FIGS. 34, 36 and 37 it can be seen that to lock the alternate embodiment structural panel 60 to the base mounting plate 90, in the base mounting plate 90 there is a first set of orifices 122 for mating engagement of threaded post 92 (used for high wind situations) and a depressed region 110 in the bottom face of the base mounting plate to matingly accommodate and lock the threaded post's bottom flange 112 beneath the base mounting plate 4. (The base mounting plate 90 is suitably connected to the decking.) The threaded post 92 is inserted through the central orifice 120 in the pin block 94 such that it extends slightly past the pin block 94. A washer 106 (FIGS. 32 and 33) is inserted down to the bottom of the void 62 such that the washer 106 rests on the inner flange 70. (FIG. 34) The profile of the planar washer 106 extends in all directions to the cell sides 120, and its central orifice is sized for the passage of the threaded shaft 122 of the polymer bolt 104 there through. In this way the washer 106 is able to spread out the tensile forces of the polymer bolt head 124 onto all of the available surface area of the inner flange 70.

A self centering polymer bolt 104 is placed into the void 62. This bolt 104 has a spiral wound spacer 108 wrapped about its threaded shaft. This is sized just slightly smaller than the dimensions of the void 62. The spacer 108 centers the bolt 104 above the threaded orifice in the threaded post 92 to simplify threaded engagement. (FIG. 34 shows a cross sectional view of the threaded post connected to the panel 60 with the base mounting plate removed for visual clarity.) The spacer 108 is flexible so as to allow some limited movement of the bolt 106 inside the void 62.

(it is envisioned that there may be the need at some time to tighten, or remove and replace these bolts. Since it is likely that this will have to be done through a small access hole drilled through the flooring on top of the structural panel 60, the self centering aspect allows the installer to do this in a minimal of room and with the smallest access hole possible.) The top of the self centering bolt 124 has a Torx™ recess for ease of connection of the driving tool to the bolt 104. (FIG. 35)

The intended application of this embodiment of the mechanical fastening system is for a saltwater environment where metal or steel fasteners are not desirable. For this reason the threaded post 92 and the polymer bolt 104 and washer 106 are made of a polymer that will not corrode or oxidize in the ocean air environment.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A system for the attachment of a planar substrate above a structural surface, said planar substrate adapted for the attachment of a flooring product, comprising;

a structural panel having a top face, a bottom face and a repeatable series of adjacent open voids formed therethrough, said voids with four tapered, internal void sides sloping inward toward a center of said void, wherein said top face of said panel has linear rabbets formed along each of a cell's top edge at an interface between the top of said void sides and said top face of said panel;

at least one four sided, four cornered, planar rigid clip for the retention of said structural panel onto a structural surface or member located there below said clip having a small tab extending from each of said four clip sides dimensionally sized for engagement with said rabbets, and wherein said four corners are bent with respect to said plane of said clip, and said clip having a hemispherical indentation formed thereon with an orifice formed therethrough a midpoint of said indentation;

a mechanical fastener having a threaded shaft with a hemispherical body drive head at a proximal end of said shaft, wherein said mechanical fastener is capable of pivotal movement within said hemispherical indentation of said clip, while said hemispherical indentation remains completely matingly engaged by an outer surface of said hemispherical body drive head;

wherein when said clip is inserted into said cell said small tabs engage in said rabbets, and said corners frictionally engage said internal void sides.

2. The system for the attachment of a planar substrate above a structural surface of claim 1 wherein said shaft has a first outer diameter and said orifice has an inner diameter, wherein said inner diameter exceeds said first outer diameter.

3. The system for the attachment of a planar substrate above a structural surface of claim 2 wherein said hemispherical drive head has a second outer diameter and said second outer diameter exceeds said inner diameter.

* * * * *